US007151240B2

(12) United States Patent
Joubran et al.

(10) Patent No.: US 7,151,240 B2
(45) Date of Patent: Dec. 19, 2006

(54) BI-DIRECTIONAL TAMPER RESISTANT TEMPERATURE DIAL

(75) Inventors: Raymond-Paul Joubran, Pasadena, CA (US); Can Trong Nguyen, Anaheim, CA (US)

(73) Assignee: Robertshaw Controls Company, Richmond, VA (US)

( * ) Notice: Subject to any disclaimer, the term of this patent is extended or adjusted under 35 U.S.C. 154(b) by 74 days.

(21) Appl. No.: 10/908,174

(22) Filed: Apr. 29, 2005

(65) Prior Publication Data

US 2006/0109887 A1 May 25, 2006

Related U.S. Application Data

(63) Continuation-in-part of application No. 10/905,248, filed on Dec. 22, 2004.

(60) Provisional application No. 60/522,936, filed on Nov. 22, 2004.

(51) Int. Cl.
*H05B 1/02* (2006.01)

(52) U.S. Cl. ..... 219/491; 219/507; 219/494; 74/553; 292/347

(58) Field of Classification Search ..... 219/491, 219/490, 494, 507, 508, 506; 292/347–353; 74/553, 527

See application file for complete search history.

(56) References Cited

U.S. PATENT DOCUMENTS

| | | | | |
|---|---|---|---|---|
| 1,068,961 | A | 7/1913 | Baker | |
| 1,104,918 | A | 7/1914 | Mouat | |
| 1,473,774 | A | 11/1923 | Leech, Jr. | |
| 1,651,038 | A | 11/1927 | Muller | |
| 1,673,454 | A | 6/1928 | Hochstein | |
| 1,689,236 | A | 10/1928 | Fraser, Jr. | |
| 2,253,162 | A | 8/1941 | Ayers | |
| 2,953,937 | A | 9/1960 | Jackson et al. | |
| 3,203,265 | A | 8/1965 | Flegel | |
| 3,537,473 | A | 11/1970 | DeZurik, Jr. | |
| 3,597,138 | A | 8/1971 | Ray | |
| 3,810,064 | A | 5/1974 | Flegel | |
| 3,965,529 | A | 6/1976 | Hadzimahalis | |
| 4,235,323 | A | 11/1980 | Dykzeul | |
| 4,253,690 | A | 3/1981 | Hollander | |
| 4,588,851 | A | 5/1986 | Turner | |
| 4,635,680 | A | 1/1987 | Fang | |
| 4,895,043 | A | 1/1990 | Lee | |
| 4,991,461 | A * | 2/1991 | Sennett et al. | 74/553 |

(Continued)

FOREIGN PATENT DOCUMENTS

| | | |
|---|---|---|
| DE | 7137199 U | 6/1976 |

(Continued)

*Primary Examiner*—Mark Paschall
(74) *Attorney, Agent, or Firm*—Leydig, Voit & Mayer, Ltd.

(57) ABSTRACT

A bi-directional tamper resistant temperature adjustment controller interface comprises a control dial having an interior face wherein a cylindrical center boss extends therefrom, said cylindrical center boss having a substantially annular cross section, and a central axial bore adapted to receive a rotatable control member and an exterior side wall of the boss has formed therein a first and a second ring of inline recessed notches adapted for resistively engaging a deflecting member. In one embodiment of the invention the first and second ring of inline recessed notches are a first and second ring of directional serrations wherein the first ring of serrations are angularly directed in a first direction to resist rotation of the dial in one direction of rotation and the second ring of serrations are angularly directed in a second direction to resist rotation of the dial in an opposing direction of rotation.

24 Claims, 2 Drawing Sheets

U.S. PATENT DOCUMENTS

| | | | |
|---|---|---|---|
| 5,003,803 | A | 4/1991 | Richards |
| 5,230,465 | A | 7/1993 | Kostorz et al. |
| 5,363,720 | A | 11/1994 | Sanchez |
| 5,427,135 | A | 6/1995 | Kieper |
| 5,427,140 | A | 6/1995 | Bosanquet |
| 5,513,831 | A | 5/1996 | Seward |
| 5,590,682 | A | 1/1997 | Fischer |
| 5,647,389 | A | 7/1997 | Holloway |
| 5,950,982 | A | 9/1999 | Williams |
| 6,012,445 | A | 1/2000 | Santelli, Jr. |
| 6,340,148 | B1 | 1/2002 | Sung |
| 6,347,784 | B1 | 2/2002 | Philipps-Liebich et al. |
| 6,375,150 | B1 | 4/2002 | Aguirre-Esponda et al. |
| 6,471,135 | B1 | 10/2002 | Paolucci |
| 6,571,829 | B1 | 6/2003 | Kuriyama et al. |
| 6,617,954 | B1 | 9/2003 | Firestine |
| 6,745,725 | B1 | 6/2004 | Toniolo et al. |

FOREIGN PATENT DOCUMENTS

| | | |
|---|---|---|
| DE | 199 52 634 C1 | 8/2001 |
| FR | 887 583 A | 11/1943 |
| WO | WO 02/06712 | 1/2002 |

* cited by examiner

BI-DIRECTIONAL TAMPER RESISTANT TEMPERATURE DIAL

CROSS-REFERENCE TO RELATED APPLICATION

This application is a continuation-in-part application of prior U.S. patent application Ser. No. 10/905,248 filed on Dec. 22, 2004, which claims benefit of U.S. Provisional Patent Application Ser. No. 60/522,936, filed Nov. 22, 2004.

BACKGROUND OF INVENTION

The temperature of the water within a water heater is usually maintained and adjusted by a rotatable temperature dial. In the case of a gas-fired water heater, there is a temperature dial that is operatively connected to a gas controller valve that directs the flow of gas to a burner whenever the temperature of the water falls below the set temperature. For an electric water heater, there is a temperature dial that is operatively connected to a thermostat that directs electricity to a heating element whenever the temperature of the water falls below the set temperature.

Excessive water temperature is a hazard in that it may cause scalding at any of the various faucets or appliances serviced by the water heater. Accidental or inadvertent adjustment of the temperature dial can cause water to issue at unexpectedly high temperatures.

The temperature dial is located in a position that is typically easily reached and rotated. If the water heater is located in a readily accessible location, the temperature dial can easily be tampered with or moved by people or things coming into contact with the temperature dial.

Properly securing a water heater from this type of tampering typically results in additional cost and/or inconvenience as to its use. Locking the water heater into an enclosure requires either keys to be kept or a combination to be remembered. An enclosure may also hamper the installation, replacement or servicing of the water heater. Other solutions require a screwdriver or other tool to change the temperature of the temperature dial. An example of this type of device is described in U.S. Pat. No. 6,617,954, which issued on Sep. 9, 2003, which is incorporated herein by reference.

Some of the devices that have previously been developed that are associated directly with a control knob or valve to prevent tampering either involve a substantial additional cost of manufacturing or are very inconvenient to use. These devices can either lock the temperature dial or the gas controller valve/thermostat into place to physically prevent it from being rotated. Other devices serve to decouple the temperature dial and the gas controller valve or the temperature dial and the thermostat from an internal actuation mechanism. In addition to the increased costs in manufacturing, such devices are often difficult to retrofit to existing installations.

Therefore, a significant problem is the inadvertent adjustment of a temperature dial and the lack of a solution that does not involve significant inconvenience or increased manufacturing costs.

The present invention is directed to overcoming one or more of the problems set forth above.

SUMMARY OF INVENTION

This invention relates generally to control dials and, more particularly, to temperature control dials for heating devices such as, for example, hot water heaters.

In one aspect of the invention a tamper resistant temperature adjustment controller interface comprises a control dial having an interior face where a cylindrical center boss extends therefrom, said cylindrical center boss having a substantially annular cross section, and a central axial bore adapted to receive a rotatable control member, and an exterior side wall of the cylindrical center boss having formed therein a first and a second ring of inline recessed notches adapted for resistively engaging a deflecting member. In one embodiment of the invention the first and second ring of inline recessed notches are a first and second ring of directional serrations wherein the first ring of directional serrations are angularly directed in a first direction to resist rotation of the dial in one direction of rotation and the second ring of directional serrations are angularly directed in a second direction to resist rotation of the dial in an opposing direction of rotation.

In another embodiment of the invention the tamper resistant controller interface comprises a controller unit having a faceplate and a rotatable control member extending from the controller and said cylindrical center boss of the control dial is mounted thereon; a resilient flexible deflectable pawl lever having a dial engagement end having first and second hooks; and a distal mounting end mounted on the faceplate such that the dial engagement end of the deflectable pawl lever is positioned wherein the first and second hooks each engage one of the first and second rings of serrations to resist rotation of the dial.

In yet another embodiment of the invention the first and second ring of directional serrations form a directional sawtooth pattern and said first and second rings of directional serrations are immediately adjacent along the length of the cylindrical center boss and at a distal end of the boss with respect to the interior face of the dial and the first and second hooks are shaped to conform to the shape of a directional serration for optimal resistance to rotation.

The present invention also involves a method of adjusting a tamper resistant temperature adjustment controller interface comprising the steps of providing a control dial having an interior face wherein a cylindrical center boss extends therefrom, said cylindrical center boss having a substantially annular cross section, and a central axial bore adapted to receive a rotatable control member and an exterior side wall of the cylindrical center boss has formed therein a first and a second ring of inline recessed notches adapted for resistively engaging a deflecting member; attaching the control dial to the rotatable control member; and selectively engaging and disengaging the first and the second ring of notches with the deflecting member to selectively resist adjusting the dial when selectively engaging and selectively allowing adjusting the dial when selectively disengaging.

These are merely some of the innumerable aspects of the present invention and should not be deemed an all-inclusive listing of the innumerable aspects associated with the present invention. These and other aspects will become apparent to those skilled in the art in light of the following disclosure and accompanying drawings.

BRIEF DESCRIPTION OF DRAWINGS

For a better understanding of the present invention, reference may be made to the accompanying drawings in which.

DETAILED DESCRIPTION OF THE INVENTION

Figure 1:
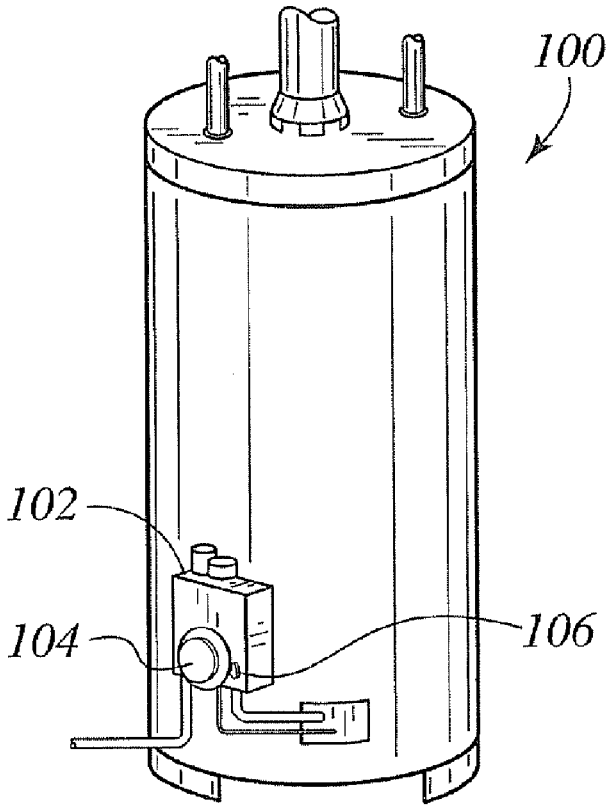
FIG. 1 is a temperature heating device having an adjustment interface.

According to the embodiment(s) of the present invention, various views are illustrated in FIGS. 1–5 and identical reference numerals are being used consistently throughout to refer to like and corresponding parts of the invention for all of the various views and figures of the drawing. Also, please note that the first digit(s) of the reference number for a given item or part of the invention should correspond to the FIG. number in which the item or part is first identified.

One embodiment of the present invention comprising a bi-directional tamper resistant control dial teaches a novel apparatus and method for making a control dial tamper resistant such that temperature adjustment can not be made accidentally.

The present invention is a bi-directional tamper resistant temperature adjustment controller interface comprising a control dial having an interior face wherein a cylindrical center boss extends therefrom. The cylindrical center boss can have a substantially annular cross section, and a central axial bore adapted to receive a rotatable control member. An exterior side wall of the cylindrical center boss can have formed therein a first and a second ring of inline recessed notches adapted for resistively engaging a deflecting member. For one embodiment of the invention the first and second ring of inline recessed notches can be a first and second ring of directional serrations wherein the first ring of directional serrations can be angularly directed in a first direction to resist rotation of the dial in one direction of rotation and the second ring of directional serrations can be angularly directed in a second direction to resist rotation of the dial in an opposing direction of rotation. Rotation of the dial is restricted by engaging the directional serrations with a deflecting member.

The bi-directional tamper resistant controller interface can also include a controller unit having a face plate and a rotatable control member extending from the controller and said cylindrical center boss of the control dial is mounted thereon; and a resilient flexible deflectable pawl lever that can have a dial engagement end having first and second hooks and a distal mounting end mounted on the faceplate such that the dial engagement end of the deflectable pawl lever can be positioned wherein the first and second hooks each engage one of the first and second rings of directional serrations to resist rotation of the dial.

One embodiment of the present invention can be such that the first and second ring of directional serrations form a directional sawtooth pattern and the first and second rings of directional serrations are immediately adjacent along the length of the cylindrical center boss and at a distal end of the boss with respect to the interior face of the dial and the first and second hooks can be shaped to conform to the shape of a directional serration for optimal resistance to rotation. One embodiment of the present invention is such that the central axial bore can include inward radial projections sized to conform to the outermost dimension of a rotatable control member.

One embodiment of the bi-directional tamper resistant controller interface can be such that the interior face of the dial has an inwardly concave contour wherein the cylindrical center boss extends from a central apex of the contour. The distal mounting end of the deflectable pawl can be fixedly mounted to the faceplate and the deflectable pawl can be sufficiently pliable to allow bending of the deflectable pawl to disengage the first and second hooks from the first and second rings of directional serrations.

The distal mounting end of the deflectable pawl can be designed to be movably mounted to the faceplate such that the deflectable pawl can be moveable from an engaged position to a disengaged position to allow for engaging and disengaging of the deflectable pawl to disengage the first and second hooks from the first and second rings of directional serrations. The mounting to the faceplate can be a pivotal mounting. The deflectable pawl can include a handle portion adapted for grasping between fingers of a human adapted for moving the deflectable pawl in a manner to engage and/or disengage the hooks of the deflectable pawl away from the directional serrations of the dial. One embodiment of the deflectable pawl can be designed such that it can be substantially L-shaped wherein a leg portion of the deflectable pawl extends from the distal mounting end to the dial engagement end and a base portion extends from the dial engagement end to the handle portion.

The deflectable pawl can be designed such that it can be positioned between the dial and faceplate and the handle portion can extend beyond an outermost perimeter of the dial for ease of access. The deflectable pawl can be a resilient flexible unitary body and the dial, including the cylindrical center boss can be a substantially rigid unitary body.

The present invention also relates to a method of adjusting a bi-directional tamper resistant temperature adjustment controller interface comprising the steps of providing a control dial having an interior face wherein a cylindrical center boss extends therefrom, said cylindrical center boss having a substantially annular cross section, and a central axial bore adapted to receive a rotatable control member and an exterior side wall of the cylindrical center boss having formed therein a first and a second ring of inline recessed notches adapted for resistively engaging a deflecting member; attaching the control dial to the rotatable control member; and selectively engaging and disengaging the first and the second ring of inline recessed notches with the deflecting member to selectively resist adjusting the dial when selectively engaging and selectively allowing adjusting the dial when selectively disengaging.

The details of the present invention and various embodiments can be better understood by referring to the Figures of the drawing. FIG. 1 is an illustrative perspective view of a heating device 100. The heating device 100, as shown in FIG. 1, is illustrative of a hot water heater, however, this application and the claims herein are in no way limited to a hot water heating device. There is a controller unit 102 attached to the heating device 100. The controller unit 102 can include but is not limited to a gas control valve for controlling gas flow as well as a thermostat for sensing temperature. Alternatively, the controller unit 102 could include an electrical current regulator and thermostat for controlling an electrical heating element of the heating device. The controller unit 102 is operable to control the heat source to maintain a desired temperature. The controller unit 102 can include a controller cover panel 106 which further comprises an interfacing control member 104 which is illustrated as a rotatable control dial. The rotable control dial 104 can be utilized to adjust the controller unit 102 thereby controlling the temperature. The rotable control dial 104 can be grasped and turned with sufficient torque in a counter-clockwise and clockwise direction in order to vary the temperature setting.

Figure 2:
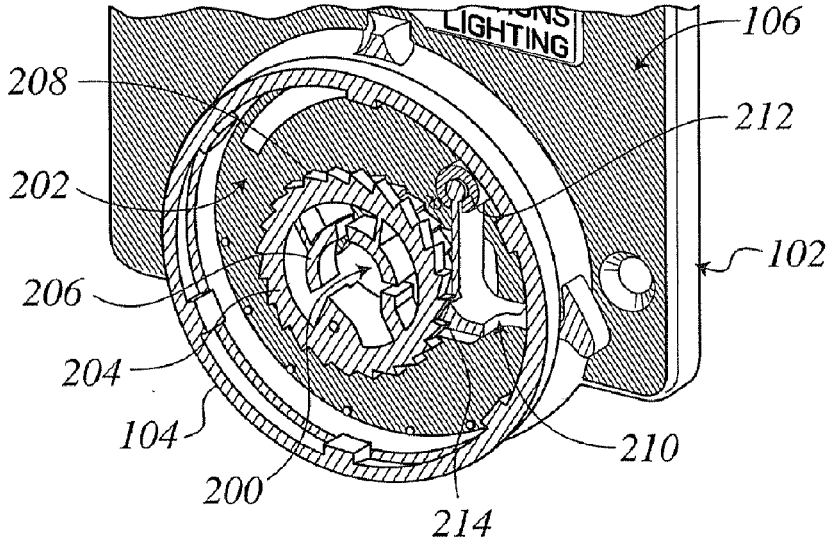
FIG. 2 is a cutaway perspective view of the control dial and controller panel interface.

Referring to FIG. 2, a cutaway view of the interfacing control member or rotable control dial 104 and controller unit 102 are shown, which reveals the interfacing to the interfacing control member or rotable control dial 104 and controller unit 102. The controller unit 102 has a controller cover panel 106. The controller unit 102 can include a rotatable controller adjustment member (not shown) which extends through an opening 200 of the controller cover panel 106. The rotatable controller adjustable member can be, for example, a shaft extending through the opening 200 of the controller cover panel 106 beyond an exterior surface 202 of the controller cover panel 106 wherein the rotatable controller adjustment member or rotatable shaft is operable to rotate and adjust the controller unit when said rotatable shaft is rotated in a clockwise and counterclockwise manner. A first end of the rotatable shaft can operably connect in an opening 414 (See FIG. 4) of the controller cover panel 106. The interfacing control member 104 is shown in FIG. 2 as a circular dial that can be turned with sufficient torque such that the rotatable controller adjustment shaft attached thereto is rotated thereby controlling the control unit.

The radial projections 208, e.g., directional serrations, form a series of inline recessed notches or directional serrations in the cylindrical center boss 204 as shown in FIG. 2. The radial projections 208, e.g., directional serrations, shown in FIG. 2 are shown as directional serrations whose points or apex directionally angularly project with respect to the triangular base of each directional serration to provide greater resistance to rotation of the dial in a first direction of rotation and a lesser resistance to the rotation of the dial in an opposing direction of rotation. The radial projections 208, e.g., directional serrations, as shown includes two inline adjacent serration rings and one will provide a greater resistance to rotation of the dial in a clockwise direction and a lesser resistance to rotation of the dial in a counterclockwise rotation and the second will perform the opposite resistance function. The resistance to rotation is effected by the engagement 214 of a deflectable pawl 210 and the series of radial projections 208. The deflectable pawl 210 levers are shown extending and crossingly engaging the projections or radial projections 208, e.g., directional serrations. The deflectable pawl 210 levers are shown, for example, connected to the faceplate 106 by being press fit into a pawl boss 212. The deflectable pawl lever has sufficient length such that a dial engagement end of the deflectable pawl 210 extends to crossingly engage the radial projections 208, e.g., directional serrations, thereby providing a greater resistance to a first direction of rotation of the rotable control dial 104 and a lesser resistance to an opposing rotation of the dial.

Figure 3:
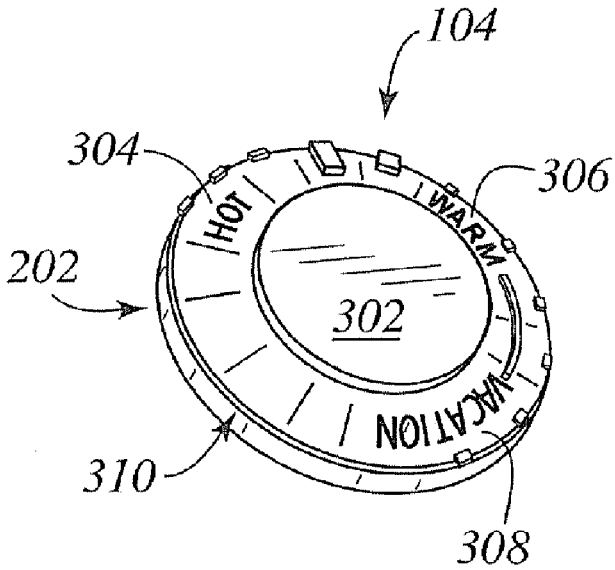
FIG. 3 is a front perspective view of the control dial.

Referring to FIG. 3, a front perspective view of the interfacing control member or rotable control dial 104 is shown. The interfacing control member 104 includes a side rim 300 for ease of grasping and turning. The interfacing control member 104 can also include multiple graduated markings 304, 306, 308 as for example shown as hot, warm and vacation. The multiple graduated markings 304, 306, 308 can obviously vary without departing from the scope of the claimed invention. The interfacing control member 104 also has a facing surface 202.

Figure 5:
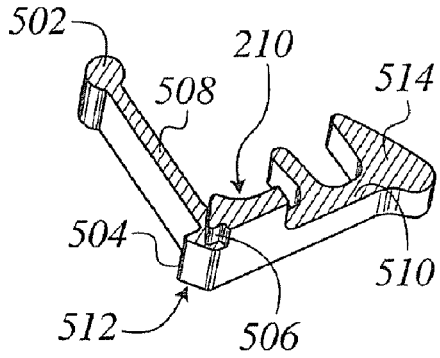
FIG. 5 is a perspective view of the deflectable pawl lever.
Figure 4:
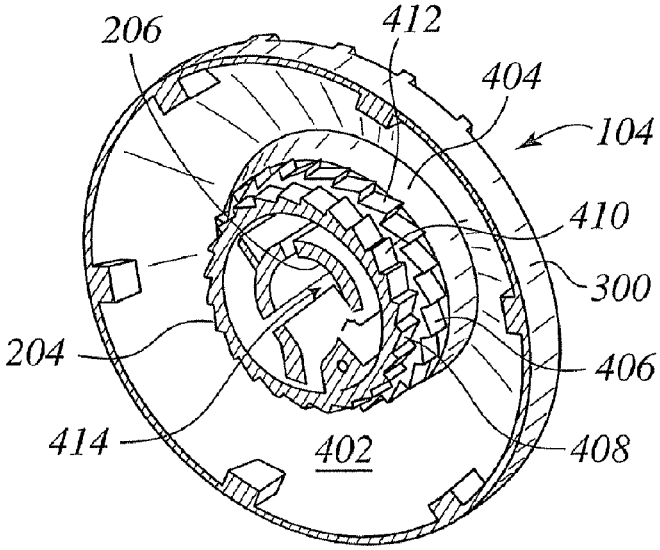
FIG. 4 is a rear perspective view of the control dial.

Referring now to FIGS. 2, 4 and 5, the boss 204 acts as a ratchet, which includes a resilient flexible deflectable pawl lever 210. The resilient deflectable pawl 210 as shown includes a leg portion 508, which is shown to extend from the mounting end 502 to the dial engagement end 512. One embodiment of the deflectable pawl 210 shown also, includes a base portion 510 that can extend from the dial engagement end 512 and to the handle portion 514, forming a substantially L-shaped unitary body. The first dial engagement end 512 can include first and second hooks 504, 506 formed therein and having an outer form factor to which is engagable with at least one of the plurality of notched portions 208 on the boss 204. For one embodiment, the deflectable pawl 210 can be mounted to the faceplate by press fitting the mounting end into a faceplate boss 212 and the deflectable pawl 210 can be generally disposed between the faceplate boss 212 and the dial engagement end 512. However, there can be an opening or notch in the circular flange 300 of the dial that allows the base portion of the deflectable pawl 210 to project through the opening and extend outside the outer surface of the circular flange 300. An illustrative, but nonlimiting, example of this operative attachment includes utilizing a securement member that encloses a mounting end portion. In the illustrative, but nonlimiting embodiment, the securement member, cylindrical center boss, having an opening and the securement portion is cylindrical and is secured by the securement member, e.g., cylindrical center boss, with the remainder of the resilient detent extending outward through the opening in the securement member. However, a wide variety of shapes and configurations of securement members and securement portions can be utilized The interior view of the rotable tamper resistant temperature dial 104, shown in FIG. 4, reveals inward radial projections 206 within the central axial bore 414 and sized to conform to the outer most dimensions of a rotatable control member. The embodiment of the inward radial projections 206 can include a for example, as shown, a first arcuate segment, a second arcuate segment, a third arcuate segment and a fourth arcuate segment. These segments are each formed at the inward most ends of the inward radial projections 206 and sized to secure the rotatable tamper resistant temperature dial 104 to a rotatable control member extending beyond the controller. The first arcuate segment is directly connected to the central axial bore 414. The second arcuate segment is connected to the central axial bore 414 through a first connective member and the third arcuate segment is connected to the central axial bore 414 through a second connective member. The fourth arcuate segment is directly connected to the bore.

The rotable tamper resistant temperature dial 104 allows the set temperature to be selected by rotation in one direction to increase the set temperature and rotation in the opposite direction to decrease the set temperature. In one embodiment as shown, this can be performed by grasping the handle portion 514 of the deflectable pawl 210 and lifting upward on the handle causing the leg portion 508 of the deflectable pawl 210 to flex thereby disengaging the first and second hooks 504, 506, from the directional serrations formed in the exterior side wall 404 of the boss 204 allowing the dial to now be turned. Releasing the handle portion 514 allows the deflectable pawl 210 to re-engage thereby resisting rotation of the dial. The bi-directional engagement of the inline serration rings 405, 408, and the first and second hooks resists rotation of the dial in both directions of rotation. The positioning of deflectable pawl 210 and its resiliency can bias the deflectable pawls 210 to engage the directional serrations when the deflectable pawl 210 is in a relaxed unflexed state. The deflectable pawl 210 can also be pivotally mounted and biased with a spring mechanism to engage the deflectable pawl 210 with the directional serration. Various other ratchet-type configurations can be utilized without going beyond the scope of the invention as disclosed and claimed. It is the turning of the water heater up or down for a warmer or colder temperature that cannot occur as the leg portion 508 of the deflectable pawl 210 will not be able to move from a notched portion of the plurality of notched portions without someone manually applying pressure on the handle portion 514 of the deflectable pawl 210 to flex or pivot the leg portion 508 of the deflectable pawl 210 away from the plurality of notched portions. The deflectable pawl 210 moves in relation thereto to the mounted end 502 portion. When the leg portion 508 and dial engagement end 512 of the deflectable pawl 210 is no longer engaged with the plurality of notched portions, the rotable tamper resistant temperature dial 104 can be rotated clockwise and counter-clockwise to the desired higher temperature. The first and second rings of inline serrations 406, 408, shown in FIG. 4, show the opposing directions of the points 412 or the apex of the serrations.

The various rotable tamper resistant temperature dial 104 examples shown above illustrate a novel apparatus and method for a bi-directional tamper resistant temperature dial. A user of the present invention may choose any of the above tamper resistant embodiments, or an equivalent thereof, depending upon the desired application. In this regard, it is recognized that various forms of the subject bi-directional tamper resistant temperature dial invention could be utilized without departing from the spirit and scope of the present invention.

The preferred embodiment of the present invention and the method of using the same has been described in the foregoing specification with considerable detail. It is to be understood that modifications may be made to the invention which do not exceed the scope of the appended claims and modified forms of the present invention performed by others skilled in the art to which the invention pertains will be considered infringements of this invention when those modified forms fall within the claimed scope of this invention.

Other aspects, objects and advantages of the present invention can be obtained from a study of the drawings, the disclosure and the appended claims. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "have," "having," "includes" and "including" and similar terms as used in the foregoing specification are used in the sense of "optional" or "may include" and not as "required." Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims that follow.

What is claimed is:

1. A tamper resistant temperature adjustment controller interface comprising:

a control dial having an interior face wherein a cylindrical center boss extends therefrom;

said boss having a substantially annular cross section, and a central axial bore adapted to receive a rotatable control member; and an exterior side wall of the boss has formed therein a first and a second ring of inline recessed notches adapted for resistively engaging a deflecting member.

2. The tamper resistant controller interface recited in claim 1, wherein the first and second ring of inline recessed notches are a first and second ring of directional serrations wherein the first ring of serrations are angularly directed in a first direction to resist rotation of the dial in one direction of rotation and the second ring of serrations are angularly directed in a second direction to resist rotation of the dial in an opposing direction of rotation.

3. The tamper resistant controller interface recited in claim 2, further comprising:

a controller unit having a faceplate and a rotatable control member extending from the controller and said cylindrical center boss of the control dial is mounted thereon; and a resilient flexible deflectable pawl lever having a dial engagement end having first and second hooks and a distal mounting end mounted on the faceplate such that the dial engagement end of the deflectable pawl lever is positioned where the first and second hooks each engage one of the first and second rings of serrations to resist rotation of the dial.

4. The tamper resistant controller interface recited in claim 3, wherein the first and second rings of directional serrations form a directional sawtooth pattern and said first and second rings are immediately adjacent along the length of the cylindrical center boss and at a distal end of the boss with respect to the interior face of the dial and the first and second hooks are shaped to conform to the shape of a serration for optimal resistance to rotation.

5. The tamper resistant controller interface recited in claim 3, wherein the central axial bore includes inward radial projections sized to conform to the outermost dimension of the rotatable control member.

6. The tamper resistant controller interface recited in claim 3, wherein the interior face of the dial has an inwardly concave contour where the cylindrical center boss extends from a central apex of the contour.

7. The tamper resistant controller interface of as recited in claim 3, wherein the distal mounting end of the deflectable pawl is fixedly mounted to the faceplate and the deflectable pawl is sufficiently pliable to allow bending of the deflectable pawl to disengage the first and second hooks from the first and second rings of serrations.

8. The tamper resistant controller interface as recited in claim 3 wherein the distal mounting end of the deflectable pawl is movably mounted to the faceplate such that the deflectable pawl can be moveable from an engaged position to a disengaged position to allow for engaging and disengaging of the deflectable pawl to disengage the first and second hooks from the first and second rings of serrations.

9. The tamper resistant controller interface as recited in claim 3, wherein the deflectable pawl includes a handle portion adapted for grasping between fingers of a human adapted for moving the deflectable pawl in a manner to engage and disengage the hooks of the deflectable pawl from the serration of the dial.

10. The tamper resistant controller interface as recited in claim 9, wherein the deflectable pawl is substantially L-shaped where a leg portion of the deflectable pawl extends from the distal mounting end to the dial engagement end and a base portion extends from the dial engagement end to the handle portion.

11. The tamper resistant controller interface as recited in claim 10, wherein the deflectable pawl is positioned between the dial and faceplate and the handle portion extends beyond an outermost perimeter of the dial for ease of access.

12. The tamper resistant controller interface as recited in claim 10, wherein the deflectable pawl is a resilient flexible unitary body and the dial including the cylindrical center boss is a substantially rigid unitary body.

13. A method of adjusting a tamper resistant temperature adjustment controller interface comprising the steps of:

providing a control dial having an interior face wherein a cylindrical center boss extends therefrom, said cylindrical center boss having a substantially annular cross section, and a central axial bore adapted to receive a rotatable control member and an exterior side wall of the cylindrical center boss has formed therein a first and a second ring of inline recessed notches adapted for resistively engaging a deflecting member;

attaching the control dial to the rotatable control member; and selectively engaging and disengaging the first and the second ring of inline recessed notches with the deflecting member to selectively resist adjusting the dial when selectively engaging and selectively allowing adjusting the dial when selectively disengaging.

14. The method of adjusting the tamper resistant controller interface recited in claim 13, wherein the step of providing a control dial is providing a control dial where the first and second ring of inline recessed notches are a first and second ring of directional serrations where the first ring of serration are angularly directed in a first direction to resist rotation of the dial in one direction of rotation and the second ring of serrations are angularly directed in a second direction to resist rotation of the dial in an opposing direction of rotation.

15. The method of adjusting a tamper resistant controller interface recited in claim 14, further comprising the steps of:

providing a controller unit having a faceplate and a rotatable control member extending from the controller and said cylindrical center boss of the control dial is mounted thereon;

providing a resilient flexible deflectable pawl lever having a dial engagement end having first and second hooks and a distal mounting end mounted on the faceplate; and engaging the dial engagement end of the deflectable pawl lever with the ring of serrations such that the deflectable pawl is positioned where the first and second hooks each engage one of the first and second rings of serrations to resist rotation of the dial.

16. The method of adjusting a tamper resistant controller interface recited in claim 15, wherein the first and second ring of directional serrations form a directional sawtooth pattern and said first and second rings are immediately adjacent along the length of the cylindrical center boss and at a distal end of the cylindrical center boss with respect to the interior face of the dial and the first and second hooks are shaped to conform to the shape of a serration for optimal resistance to rotation.

17. The method of adjusting a tamper resistant controller interface recited in claim 15, wherein the central axial bore includes inward radial projections sized to conform to the outermost dimension of the rotatable control member.

18. The method for adjusting a tamper resistant controller interface recited in claim 15, where the interior face of the dial has an inwardly concave contour wherein the cylindrical center boss extends from a central apex of the contour.

19. The method of adjusting tamper resistant controller interface of as recited in claim 15, wherein the distal mounting end of the deflectable pawl is fixedly mounted to the faceplate and the deflectable pawl is sufficiently pliable to allow bending of the deflectable pawl to disengage the first and second hooks from the first and second rings of serrations.

20. The method of adjusting tamper resistant controller interface as recited in claim 15, wherein the distal mounting end of the deflectable pawl is movably mounted to the faceplate such that the deflectable pawl can be moveable from an engaged position to a disengaged position to allow for engaging and disengaging of the deflectable pawl to disengage the first and second hooks from the first and second rings of serrations.

21. The method of adjusting a tamper resistant controller interface as recited in claim 15, wherein the deflectable pawl includes a handle portion adapted for grasping between fingers of a human adapted for moving the deflectable pawl in a manner to engage and disengage the hooks of the deflectable pawl from the serration of the dial.

22. The method of adjusting a tamper resistant controller interface as recited in claim 21, wherein the deflectable pawl is substantially L-shaped wherein a leg portion of the deflectable pawl extends from the distal mounting end to the dial engagement end and a base portion extends from the dial engagement end to the handle portion.

23. The method of adjusting a tamper resistant controller interface as recited in claim 22, wherein the deflectable pawl is positioned between the dial and faceplate and the handle portion extends beyond an outermost perimeter of the dial for ease of access.

24. The method of adjusting a tamper resistant controller interface as recited in claim 22, wherein the deflectable pawl is a resilient flexible unitary body and the dial including the cylindrical center boss is a substantially rigid unitary body.

* * * * *